US012745795B2

(12) United States Patent
Li et al.

(10) Patent No.: US 12,745,795 B2
(45) Date of Patent: Sep. 29, 2026

(54) ATOMIZER AND ELECTRONIC ATOMIZATION DEVICE

(71) Applicant: SHENZHEN SMOORE TECHNOLOGY LIMITED, Shenzhen (CN)

(72) Inventors: Guanghui Li, Shenzhen (CN); Guilin Lei, Shenzhen (CN); Yajun Xie, Shenzhen (CN); Zhouwei Chen, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 446 days.

(21) Appl. No.: 17/985,468

(22) Filed: Nov. 11, 2022

(65) Prior Publication Data

US 2023/0122358 A1 Apr. 20, 2023

Related U.S. Application Data

(63) Continuation of application No. PCT/CN2020/089825, filed on May 12, 2020.

(51) Int. Cl.

| | |
|---|---|
| ***A24F 40/10*** | (2020.01) |
| ***A24F 40/42*** | (2020.01) |
| ***A24F 40/48*** | (2020.01) |

(52) U.S. Cl.

CPC ..... *A24F 40/10* (2020.01); *A24F 40/42* (2020.01); *A24F 40/48* (2020.01)

(58) Field of Classification Search

CPC ..... A24F 40/10; A24F 40/42; A24F 40/48; A24F 40/485

See application file for complete search history.

(56) References Cited

U.S. PATENT DOCUMENTS 3,341,185 A * 9/1967 Kennedy, Sr. ..... F02M 19/00 261/50.1
2014/0216450 A1 8/2014 Liu
(Continued)

FOREIGN PATENT DOCUMENTS

CN 105795522 A 7/2016
CN 106820272 A 6/2017
(Continued)

OTHER PUBLICATIONS

English Machine Translation for CN109007980A (Year: 2018).*
(Continued)

*Primary Examiner* — Philip Y Louie
*Assistant Examiner* — Oluwatosin O Diyan
(74) *Attorney, Agent, or Firm* — Leydig, Voit & Mayer, Ltd.

(57) ABSTRACT

A vaporizer for vaporizing e-liquid includes: a liquid storage cavity for storing the e-liquid; a mounting base including a housing and a separating plate arranged in the housing, the separating plate having a through hole, and the through hole being in communication with the liquid storage cavity; a vaporization core mounted in the mounting base to heat and vaporize the e-liquid; a seal member arranged between the separating plate and the vaporization core, the seal member including an opening that is in communication with the through hole for the e-liquid to enter the vaporization core through the opening; and at least one vent groove between the mounting base and the seal member, the at least one vent groove being in communication with the liquid storage cavity and external air.

14 Claims, 8 Drawing Sheets

(56) References Cited

U.S. PATENT DOCUMENTS

| | | | | |
|---|---|---|---|---|
| 2015/0027470 | A1 | 1/2015 | Kane et al. | |
| 2017/0119055 | A1 | 5/2017 | Liu | |
| 2017/0119061 | A1 | 5/2017 | Li et al. | |
| 2018/0289072 | A1* | 10/2018 | Cadieux | A24F 40/40 |
| 2018/0343922 | A1 | 12/2018 | Stadler et al. | |
| 2020/0000151 | A1 | 1/2020 | Fraser et al. | |
| 2020/0060343 | A1 | 2/2020 | Tan et al. | |
| 2020/0085108 | A1 | 3/2020 | Li et al. | |
| 2020/0094000 | A1 | 3/2020 | Peng | |
| 2020/0107585 | A1 | 4/2020 | Atkins et al. | |
| 2021/0321671 | A1* | 10/2021 | Chen | A24F 40/46 |

FOREIGN PATENT DOCUMENTS

| | | | | | |
|---|---|---|---|---|---|
| CN | 207040889 | U | | 2/2018 | |
| CN | 207100509 | U | | 3/2018 | |
| CN | 207897892 | U | | 9/2018 | |
| CN | 109007980 | A | * | 12/2018 | A24F 40/10 |
| CN | 109452691 | A | * | 3/2019 | A24F 47/008 |
| CN | 208875418 | U | | 5/2019 | |
| CN | 209058143 | U | | 7/2019 | |
| CN | 110250576 | A | | 9/2019 | |
| CN | 110250577 | A | | 9/2019 | |
| CN | 110250583 | A | | 9/2019 | |
| CN | 110279159 | A | | 9/2019 | |
| CN | 209376699 | U | | 9/2019 | |
| CN | 110313647 | A | | 10/2019 | |
| CN | 110326818 | A | | 10/2019 | |
| CN | 209489494 | U | | 10/2019 | |
| CN | 209498584 | U | | 10/2019 | |
| CN | 110447960 | A | * | 11/2019 | A24F 40/46 |
| CN | 110613171 | A | | 12/2019 | |
| CN | 110613172 | A | | 12/2019 | |
| CN | 110638101 | A | | 1/2020 | |
| CN | 209931491 | U | | 1/2020 | |
| CN | 111011932 | A | | 4/2020 | |
| CN | 111011933 | A | | 4/2020 | |
| CN | 211048396 | U | | 7/2020 | |
| CN | 111657547 | A | | 9/2020 | |
| CN | 211558805 | U | | 9/2020 | |
| CN | 212937910 | U | | 4/2021 | |
| CN | 214710337 | U | | 11/2021 | |
| CN | 214802300 | U | | 11/2021 | |
| CN | 114158778 | A | | 3/2022 | |
| EP | 3287017 | A1 | | 2/2018 | |
| FR | 3087318 | A1 | | 4/2020 | |
| JP | 670595 | U | | 10/1994 | |
| KR | 20180124736 | A | * | 11/2018 | A24F 40/40 |
| WO | WO-2015074264 | A1 | * | 5/2015 | A24F 40/70 |
| WO | 2015157224 | A1 | | 10/2015 | |
| WO | 2016041209 | A1 | | 3/2016 | |
| WO | WO-2017035720 | A1 | * | 3/2017 | A24F 40/44 |
| WO | 2018137229 | A1 | | 8/2018 | |
| WO | 2018157638 | A1 | | 9/2018 | |
| WO | 2018161254 | A1 | | 9/2018 | |
| WO | 2020064921 | A1 | | 4/2020 | |
| WO | 2020081849 | A2 | | 4/2020 | |

OTHER PUBLICATIONS

English Machine Translation for CN109452691A (Year: 2019).*
English Machine Translation for KR 20180124736 A (Year: 2018).*
English Machine Translation for WO 2017035720A1 (Year: 2017).*
English Machine Translation for WO 2015074264 A1 (Year: 2015).*
Chinese Patent Office, Office Action in Chinese Patent Application No. 202011270990.2 (Oct. 23, 2024).
Chinese Patent Office, Office Action in Chinese Patent Application No. 202010398167.3 (Dec. 6, 2024).
Patent Cooperation Treaty, International Search Report, International Application No. PCT/CN2020/089825 (Feb. 18, 2021).
Patent Cooperation Treaty, Written Opinion of the International Searching Authority, International Application No. PCT/CN2020/089825 (Feb. 18, 2021).
Patent Cooperation Treaty, International Search Report, International Application No. PCT/CN2020/128818 (Aug. 18, 2021).
Patent Cooperation Treaty, Written Opinion of the International Searching Authority, International Application No. PCT/CN2020/128818 (Aug. 18, 2021).
Patent Cooperation Treaty, International Search Report, International Application No. PCT/CN2020/128817 (Feb. 19, 2021).
Patent Cooperation Treaty, Written Opinion of the International Searching Authority, International Application No. PCT/CN2020/128817 (Feb. 19, 2021).
Chinese Patent Office, First Office Action in Chinese Patent Application No. 202022640128.8 (Aug. 24, 2021).
Annals of the ICRP, "Human Respiratory Tract Model for Radiological Protection," Publication 66. (Year: 1994).
William C. Hinds, "Aerosol Technology: Properties, Behavior, and Measurement of Airborne Particles," John Wiley & Sons, Inc. (Year: 1999).
European Patent Office, Search Report in European Patent Application No. 20961205.0 (Dec. 21, 2023).
European Patent Office, Search Report in European Patent Application No. 20935600.5 (Jun. 7, 2023).
European Patent Office, Search Report in European Patent Application No. 20935684.9 (Sep. 22, 2023).
Chinese Patent Office, Notification of grant of patent right for invention in Chinese Patent Application No. 202011270990.2 (Jan. 16, 2025).
Chinese Patent Office, Office Action in Chinese Patent Application No. 202011270979.6 (Feb. 13, 2025).
U.S. Patent and Trademark Office, Office Action in U.S. Appl. No. 17/983,260 (Feb. 21, 2025).
Chinese Patent Office, Office Action in Chinese Patent Application No. 202010398167.3 (May 26, 2025).
Chinese Patent Office, Notification of grant of patent right for invention in Chinese Patent Application No. 202010398167.3 (Jul. 1, 2025).
U.S. Patent and Trademark Office, Advisory Action in U.S. Appl. No. 17/983,260 (Aug. 12, 2025).
U.S. Patent and Trademark Office, Office Action in U.S. Appl. No. 17/983,260 (Jun. 4, 2025).
U.S. Patent and Trademark Office, Office Action in U.S. Appl. No. 17/983,260 (Oct. 10, 2025).

* cited by examiner 0.2mm×0.2mm 0.3mm×0.2mm 0.4mmX0.2mm 0.5mmX0.2mm

ATOMIZER AND ELECTRONIC ATOMIZATION DEVICE

CROSS-REFERENCE TO PRIOR APPLICATION

This application is a continuation of International Patent Application No. PCT/CN2020/089825, filed on May 12, 2020. The entire disclosure is hereby incorporated by reference herein.

FIELD

This application relates to the field of vaporizer technologies, and in particular, to a vaporizer and an electronic vaporization device.

BACKGROUND

In the related art, an electronic vaporization device mainly includes a vaporizer and a body assembly. The vaporizer generally includes a liquid storage cavity and a vaporization assembly. The liquid storage cavity is configured to store a vaporizable medium, and the vaporization assembly is configured to heat and vaporize the vaporizable medium to form vapor that can be inhaled by an inhaler; and the body assembly is configured to supply power to the vaporizer.

When the vaporizer vaporizes the vaporizable medium, the vaporizable medium is consumed at a fast speed, and an air pressure of the liquid storage cavity is reduced, which results in poor liquid supply to the vaporization assembly, so that the vaporizable medium fails to be quickly replenished to the vaporization assembly. As a result, the vaporization assembly dry burns and is overheated, resulting in damage to the vaporization assembly due to the poor liquid supply, a burnt smell, and harmful substances.

SUMMARY

In an embodiment, the present invention provides a vaporizer, configured to vaporize e-liquid, comprising: a liquid storage cavity configured to store the e-liquid; a mounting base comprising a housing and a separating plate arranged in the housing, the separating plate comprising a through hole, and the through hole being in communication with the liquid storage cavity; a vaporization core mounted in the mounting base and configured to heat and vaporize the e-liquid; a seal member arranged between a separating plate and the vaporization core, the seal member comprising an opening that is in communication with the through hole for the e-liquid to enter the vaporization core through the opening; and at least one vent groove between the mounting base and the seal member, the at least one vent groove being in communication with the liquid storage cavity and external air.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
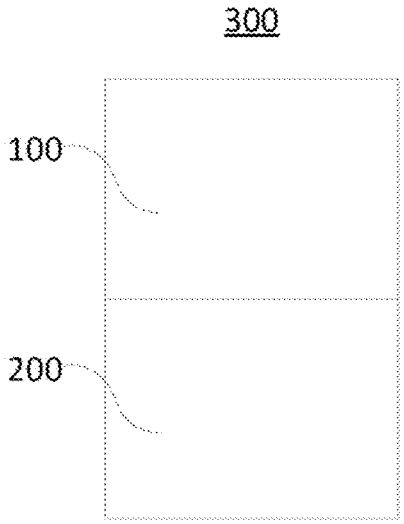
FIG. 1 is a schematic structural diagram of an embodiment of an electronic vaporization device according to this application.

In an embodiment, the present invention provides a vaporizer and an electronic vaporization device to resolve the problem of poor liquid supply of the electronic vaporization device.

In an embodiment, the present invention provides a vaporizer. The vaporizer is configured to vaporize e-liquid, including: a liquid storage cavity, configured to store the e-liquid; a mounting base, including a housing and a separating plate arranged in the housing, where the separating plate includes a through hole, and the through hole is in communication with the liquid storage cavity; a vaporization core, mounted in the mounting base, and configured to heat and vaporize the e-liquid; and a seal member, arranged between the separating plate and the vaporization core, where the seal member includes an opening that is in communication with the through hole, and the e-liquid enters the vaporization core through the opening, where a vent groove is provided between the mounting base and the seal member, and the vent groove is in communication with the liquid storage cavity and external air.

In some embodiments, the vent groove is provided on a side of the separating plate that faces away from the liquid storage cavity. In some embodiments, the side of the separating plate that faces away from the liquid storage cavity is further provided with a buffer groove, the vent groove flows through the buffer groove, a cross-sectional area of the buffer groove in a path direction of the vent groove is greater than a cross-sectional area of the vent groove in a same direction, and the seal member covers the vent groove and the buffer groove. In some embodiments, a depth of the vent groove ranges from 0.1 mm to 0.5 mm, a width of the vent groove in a direction perpendicular to the path direction ranges from 0.1 mm to 0.5 mm, a width of the buffer groove is greater than the width of the vent groove, and a depth of the buffer groove is greater than or equal to the depth of the vent groove.

In some embodiments, the separating plate is provided with two vent grooves, and the two vent grooves are adjacent to each other in an end-to-end manner and are provided around a hollow portion of the through hole.

In some embodiments, the seal member includes a seal ring gasket and two isolation gaskets separately arranged on two opposite ends of the seal ring gasket, the seal ring gasket includes the opening, the isolation gasket abuts against the housing, and an air inlet of the vent groove is exposed from the seal ring gasket and is misaligned with the isolation gasket.

In some embodiments, the vent groove is provided on the housing arranged on a side of the separating plate that faces away from the liquid storage cavity, and a vent opening of the vent groove is provided on the separating plate.

In some embodiments, a side of the seal member that faces the separating plate and/or a side of the seal member that faces the vaporization core are/is provided with the vent groove.

In some embodiments, the vaporizer further includes a base, the base is connected to the mounting base, the base abuts against the vaporization core, a vaporization cavity is formed between the base, the vaporization core, and the mounting base, the vent groove is in communication with the vaporization cavity, a bottom wall of the base that faces away from the mounting base is provided with a vent hole, and the vent hole is in communication with the vaporization cavity and the external air.

In order to resolve the technical problem, another technical solution adopted in this application is to provide an electronic vaporization device. The electronic vaporization device includes a body assembly and the vaporizer as described above, and the body assembly is connected to the vaporizer and supplies power to the vaporizer.

The beneficial effects of this application are: different from a situation in the related art, this application discloses a vaporizer and an electronic vaporization device. In this application, the vent groove is provided between the mounting base and the seal member, and the vent groove is in communication with the liquid storage cavity and the external air. As a result, dynamic balance is achieved between the air pressure, hydraulic pressure, and the capillary tension and resistance exerted by the vent groove on the e-liquid in the liquid storage cavity and the external air pressure by adjusting the e-liquid stored in the vent groove. In addition, when the air pressure in the liquid storage cavity of the vaporizer is too low, the external air can enter the liquid storage cavity through the vent groove, thereby increasing the air pressure in the liquid storage cavity, so as to avoid a situation of poor liquid flow due to the extremely low air pressure in the cavity, and the quality of the vaporizer is improved.

The technical solutions in the embodiments of this application are clearly and completely described in the following with reference to the accompanying drawings in the embodiments of this application. Apparently, the described embodiments are merely some rather than all of the embodiments of this application. All other embodiments obtained by a person skilled in the art based on the embodiments of this application without creative efforts shall fall within the protection scope of this application.

In this embodiment of this application, the terms "first", "second" and "third" are used merely for the purpose of description, and shall not be construed as indicating or implying relative importance or implying a quantity of indicated technical features. Therefore, features defining "first" "second" and "third" can explicitly or implicitly include at least one of the features. In description of this application, "more" means at least two, such as two and three unless it is specifically defined otherwise. In addition, the terms "include", "have", and any variant thereof are intended to cover a non-exclusive inclusion. For example, a process, method, system, product, or device that includes a series of steps or units is not limited to the listed steps or units; and instead, further optionally includes a step or unit that is not listed, or further optionally includes another step or unit that is intrinsic to the process, method, product, or device.

"Embodiment" mentioned in the specification means that particular features, structures, or characteristics described with reference to the embodiment may be included in at least one embodiment of this application. The term appearing at different positions of the specification may not refer to the same embodiment or an independent or alternative embodiment that is mutually exclusive with another embodiment. A person skilled in the art explicitly or implicitly understands that the embodiments described in the specification may be combined with other embodiments.

Figure 2:
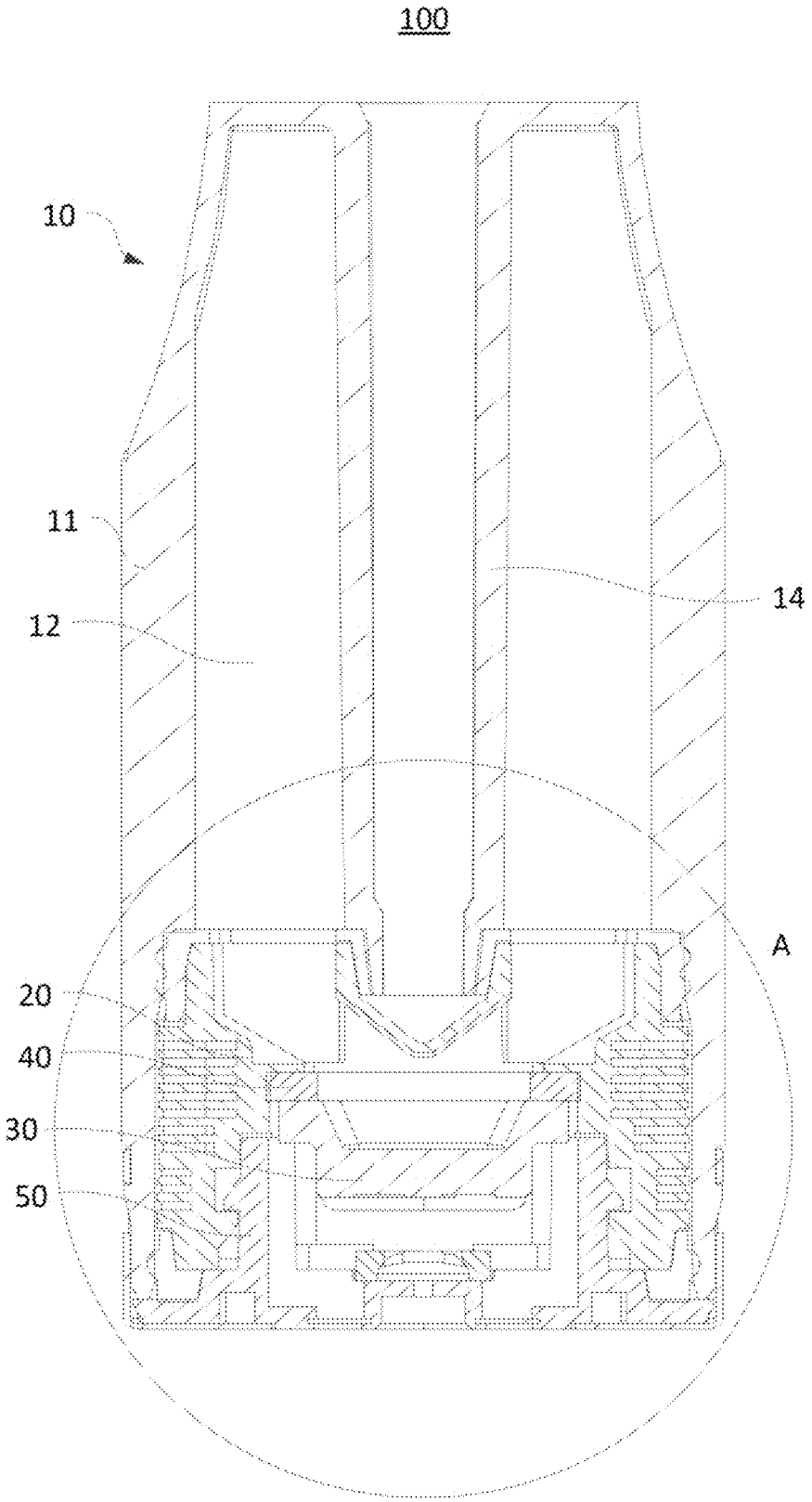
FIG. 2 is a schematic diagram of a cross-sectional structure of a vaporizer in the electronic vaporization device shown in FIG. 1.
Figure 3:
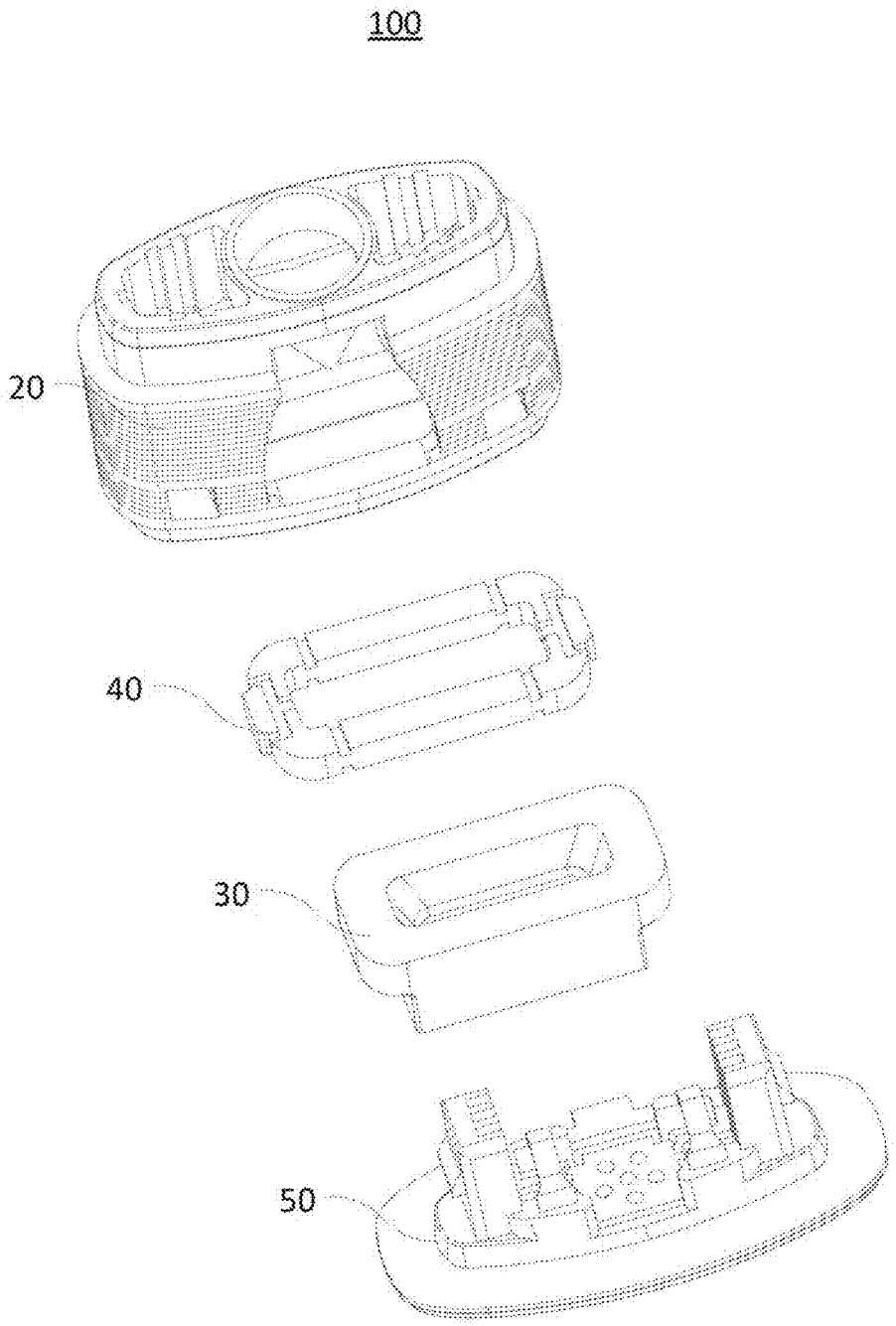
FIG. 3 is a schematic exploded view of a vaporizer in the electronic vaporization device shown in FIG. 1.
Figure 4:
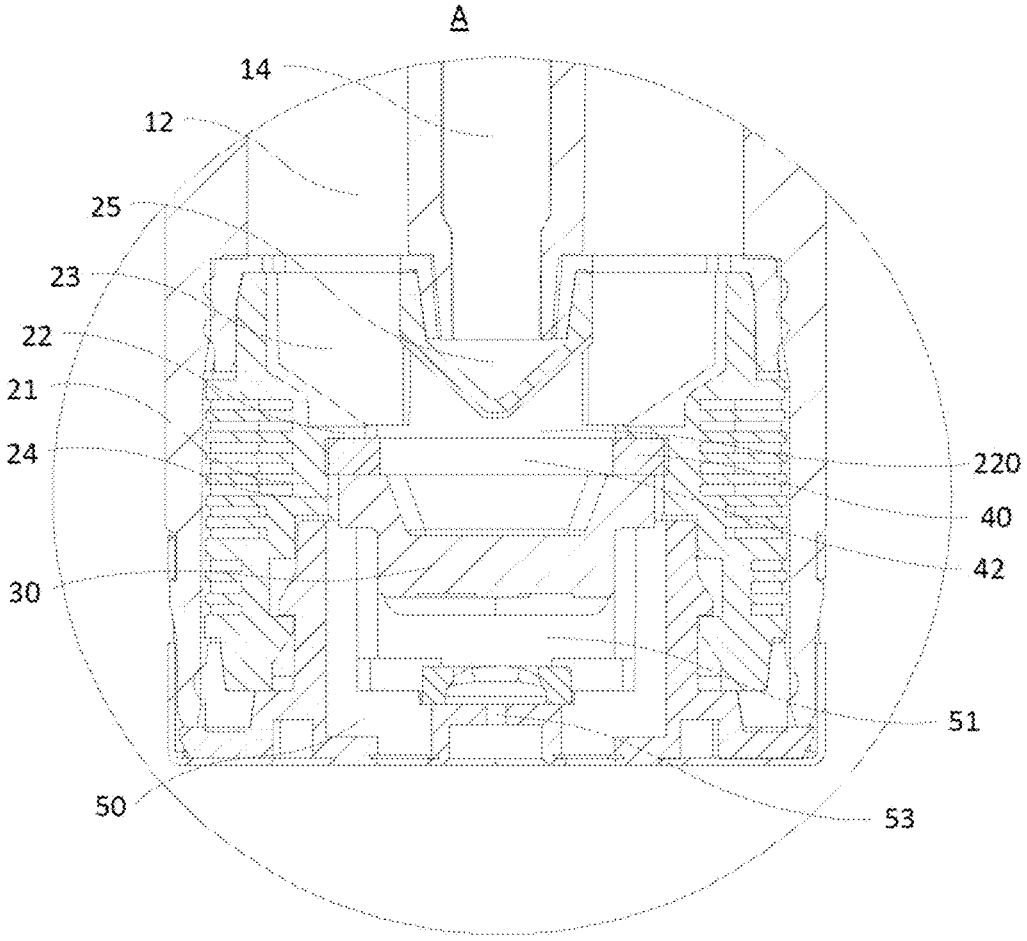
FIG. 4 is an enlarged schematic diagram of a region A of the vaporizer shown in FIG. 2.

This application provides an electronic vaporization device 300. Referring to FIG. 1 to FIG. 4, FIG. 1 is a schematic structural diagram of an embodiment of an electronic vaporization device according to this application, FIG. 2 is a schematic diagram of a cross-sectional structure of a vaporizer in the electronic vaporization device shown in FIG. 1, FIG. 3 is a schematic exploded view of the vaporizer shown in FIG. 1, and FIG. 4 is an enlarged schematic diagram of a region A shown in FIG. 2.

The electronic vaporization device 300 may be configured to vaporize e-liquid. The electronic vaporization device 300 includes a vaporizer 100 and a body assembly 200 that are connected to each other. The vaporizer 100 is configured to store the e-liquid and vaporize the e-liquid to form vapor that can be inhaled by a user. The body assembly 200 is configured to supply power to the vaporizer 100, so that the vaporizer 100 can vaporize the e-liquid to form the vapor.

As shown in FIG. 2, the vaporizer 100 generally includes a vaporization sleeve 10, a mounting base 20, a vaporization core 30, a seal member 40, and a base 50.

The vaporization sleeve 10 includes a liquid storage cavity 11, the liquid storage cavity 12 includes a liquid storage cavity 12, the vaporization sleeve 10 further includes a vent tube 14 provided inside, the liquid storage cavity 12 is configured to store the e-liquid, and the vent tube 14 is configured to guide the vapor to the mouth of the user.

As shown in FIG. 2 and FIG. 4, the mounting base 20 includes a housing 21 and a separating plate 22 that is arranged in the housing 21. The separating plate 22 includes a through hole 220, and the through hole 220 is in communication with the liquid storage cavity 12, that is, the through hole 220 is in communication with the liquid storage cavity 12.

In this embodiment, the separating plate 22 divides a space in the housing 21 into a liquid inlet cavity 23 and an access cavity 24. The liquid inlet cavity 23 is in communication with the access cavity 24 through the separating plate 22, and the housing 21 is further provided with a vapor outlet 25 on a same side as the liquid inlet cavity 23. The mounting base 20 is embedded in the vaporization sleeve 10, and the vent tube 14 is connected to the vapor outlet 25, so as to guide the vapor to the mouth of the user through the vapor outlet 25 and the vent tube 14.

In another embodiment, the separating plate 22 can be connected to one end of the housing 21 that faces the liquid storage cavity 12, so that the separating plate 22 does not need to form a liquid inlet cavity 23 with the housing 21; or the separating plate 22 is connected to one end of the housing 21 that faces away from the liquid storage cavity 12, so that the separating plate 22 does not need to form an access cavity 24 with the housing 21. This application does not limit a specific structure of the mounting base 20, and the following matching relationship between the mounting base 20, the vaporization core 30, and the seal member 40 is applicable to various deformed structures of the mounting base 20.

In another embodiment, the mounting base 20 may not be embedded in the vaporization sleeve 10, but the through hole 220 needs to be in communication with the liquid storage cavity 11. For example, the liquid storage cavity 11 is a flexible liquid storage tank, a liquid storage ball, or the like, and is connected to the separating plate 22 and the liquid storage cavity 12 is in communication with the through hole 220.

The separating plate 22 may be a plate body with a through hole 220 in a middle portion, or a plate member with a plurality of through holes 220 in the middle portion, and the through holes 220 on the separating plate 22 need to be in communication with the liquid storage cavity 12, which is not limited in this application.

Still referring to FIG. 2 and FIG. 4, the vaporization core 30 is assembled in the access cavity 24 and blocks the liquid inlet cavity 23, the vaporization core 30 is in communication with the liquid inlet cavity 23, and then a liquid storage space is formed by the vaporization sleeve 10, the mounting base 20, and the vaporization core 30. The liquid storage space stores the e-liquid, and the liquid inlet cavity 23 and the through hole 220 guide the e-liquid to the vaporization core 30. In this way, the vaporization core 30 vaporizes the e-liquid to form vapor, and then the vapor is guided to the mouth of the user through the vapor outlet 25 and the vent tube 14.

The seal member 40 is arranged on a side of the separating plate 22 that faces away from the liquid storage cavity 12 and is arranged between the separating plate 22 and the vaporization core 30, and the vaporization core 30 abuts against the seal member 40 to prevent the e-liquid from leaking. The seal member 40 includes an opening 42 that is in communication with the through hole 220. Therefore, the opening 42 is in communication with the liquid storage cavity 12, and the e-liquid enters the vaporization core 30 through the opening 42. As shown in FIG. 2 and FIG. 3, the base 50 is connected to and covers one end of the mounting base 20 that faces away from the vaporization sleeve 10.

In addition, the base 50 abuts against the vaporization core 30 to cause the vaporization core 30 to abut against the seal member 40, and a space formed by the mounting base 20, the vaporization core 30, and the base 50 forms the vaporization cavity 51. The vaporization core 30 vaporizes the e-liquid and forms vapor in the vaporization cavity 51, and the vaporization cavity 51 is in communication with the vapor outlet 25.

An electrode is further connected in the base 50, and the electrode is electrically connected to the vaporization core 30 to supply power to the vaporization core 30.

A bottom wall of the base 50 that faces away from the mounting base 20 is provided with a vent hole 53 that is in communication with the vaporization cavity 51, and the vent hole 53 is in communication with the vaporization cavity 51 and the external air.

The user inhales the electronic vaporization device 300, and the vaporization core 30 vaporizes the e-liquid. In addition, as the user inhales, the external air enters the vaporization cavity 51 through the vent hole 53, and carries the vapor in the vaporization cavity 51 to flow through the vapor outlet 25 and the vent tube 14 to the mouth of the user.

In this application, referring to FIG. 4 to FIG. 7, a vent groove 26 is provided between the mounting base 20 and the seal member 40, and the vent groove 26 is in communication with the liquid storage cavity 12 and the external air. After the e-liquid is stored in the liquid storage space, the e-liquid seals the vent groove 26.

The vent groove 26 can be in communication with the vaporization cavity 51 and the liquid storage cavity 12, and further be in communication with the liquid storage cavity 12 and the external air through the vaporization cavity 51. Alternatively, the vaporization sleeve 10 is provided with a through hole, the vent groove 26 is in communication with the through hole and the liquid storage cavity 12, and the through hole is in communication with the external air.

When the e-liquid in the liquid storage cavity 12 is consumed, if supplementary air is not available in the liquid storage cavity 12, the air pressure in the liquid storage cavity 12 continues to be reduced. When the air pressure in the cavity is reduced to a certain extent, the e-liquid does not flow smoothly. As a result, because of the lack of sufficient liquid supply, the vaporization core 30 is prone to produce a burnt smell and the efficiency of generating vapor is reduced, which ultimately brings a poor inhaling experience to the user. Alternatively, when the vaporization core 30 vaporizes the e-liquid, the air in the liquid storage cavity 12 is heated, and the air pressure in the cavity is increased. Excessive air pressure in the liquid storage cavity causes the e-liquid to leak out from each connection portion, and these factors greatly reduce the quality of the electronic vaporization device 300.

Therefore, in this application, the vent groove 26 is provided between the mounting base 20 and the seal member 40, and the vent groove 26 is in communication with the liquid storage cavity 12 and the external air. As a result, dynamic balance is achieved between the air pressure, hydraulic pressure, and the capillary tension and resistance exerted by the vent groove 26 on the e-liquid in the liquid storage cavity 12 and the external air pressure by adjusting the e-liquid stored in the vent groove 26.

In this way, a situation of poor liquid flow and liquid leakage of the vaporizer 100 can be avoided, and the quality of the vaporizer 100 is improved.

Specifically, when the air pressure in the liquid storage cavity 12 is reduced and reaches a negative pressure threshold, the external air can enter the liquid storage cavity 12 through the vent groove 26 to implement ventilation, and to cause the air pressure in the liquid storage cavity 12 to increase. As a result, a situation of poor liquid flow caused by extremely low air pressure in the cavity is avoided, and the quality of the vaporizer 100 is improved. When the air pressure in the liquid storage cavity 12 is increased due to being heated and temperature increase, the amount of e-liquid entering the vent groove 26 is increased. Therefore, the air pressure in the liquid storage cavity 12 can be appropriately reduced to avoid the occurrence of liquid leakage, and the quality of the vaporizer 100 is also improved.

Figure 5:
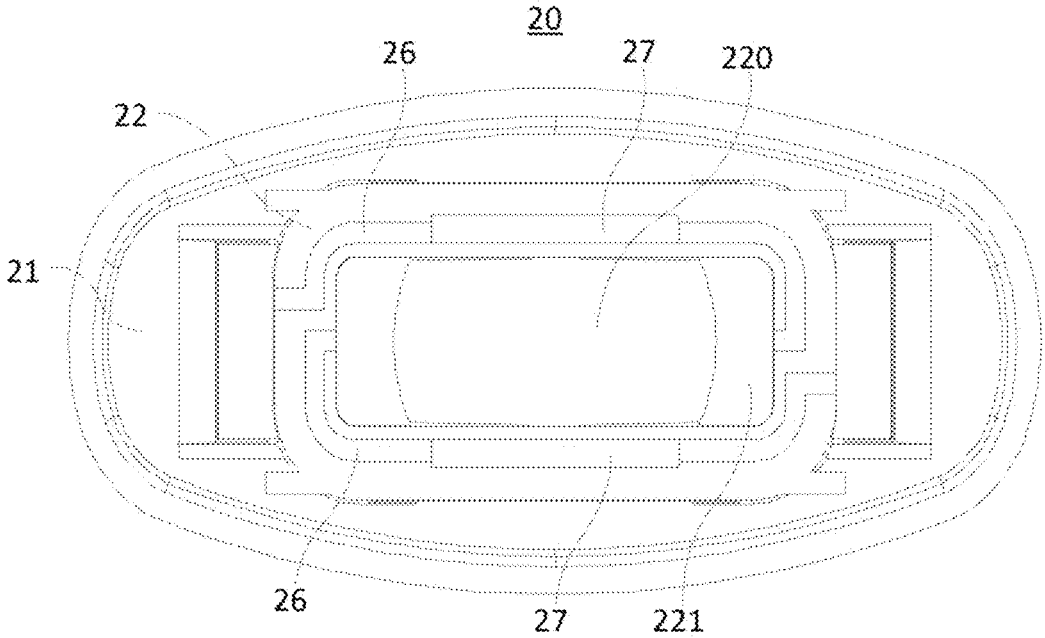
FIG. 5 is a schematic structural diagram of a bottom view of a mounting base of the vaporizer shown in FIG. 4.
Figure 6:
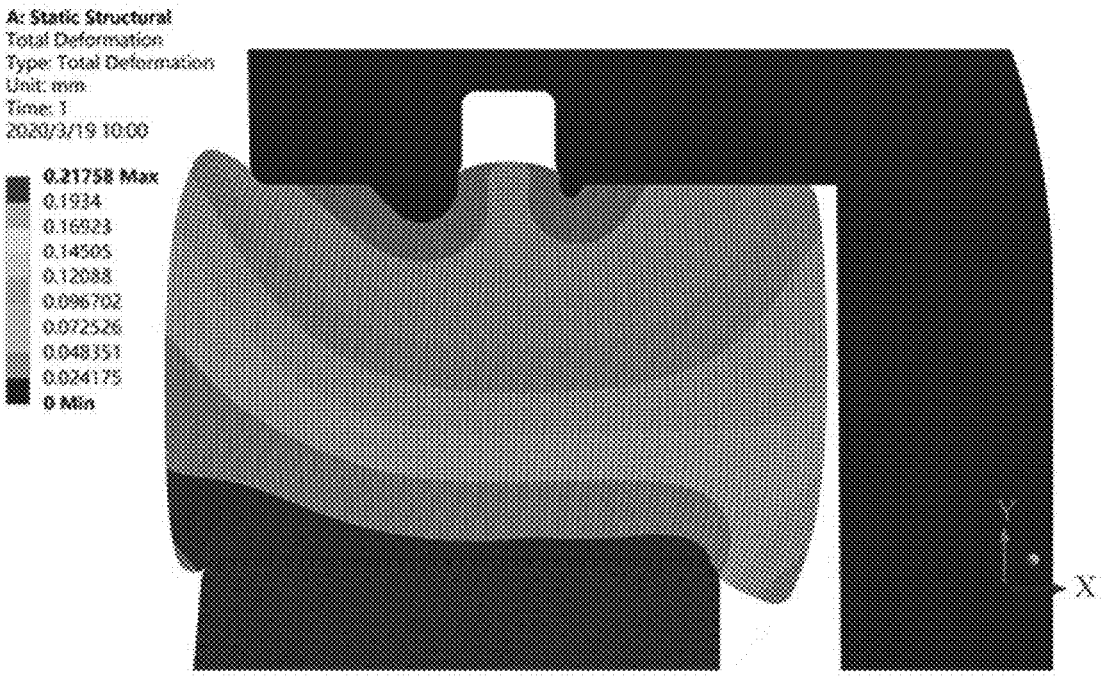
FIG. 6 is a schematic diagram of simulation analysis of providing a vent groove and a seal member that are of a first specification on a separating plate shown in FIG. 5.
Figure 7:
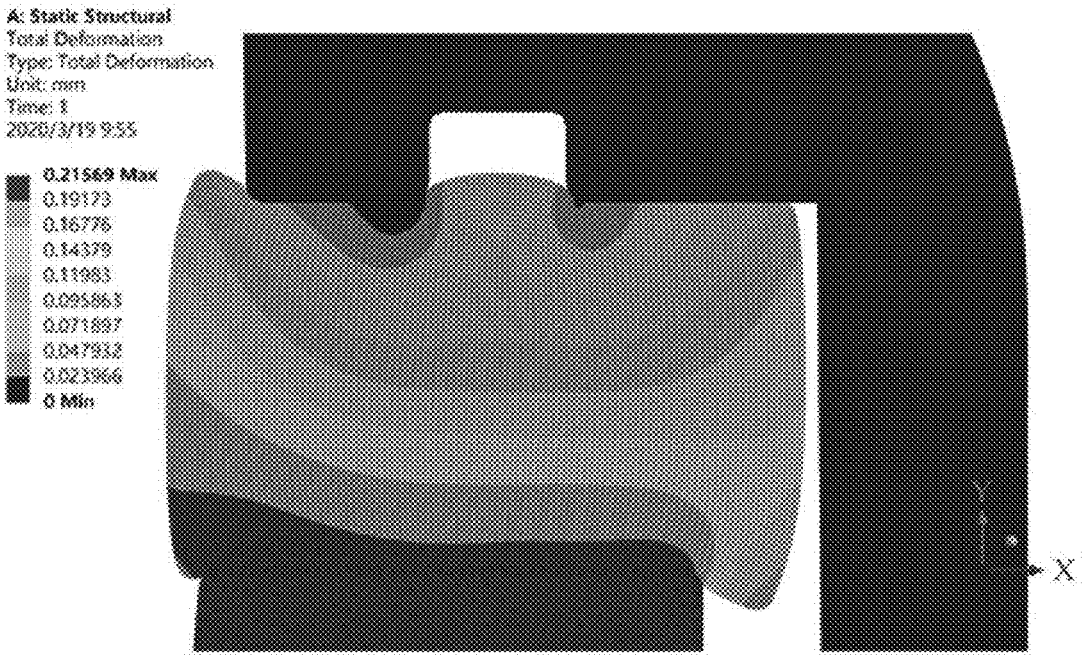
FIG. 7 is a schematic diagram of simulation analysis of providing a vent groove and a seal member that are of a second specification on a separating plate shown in FIG. 5.
Figure 8:
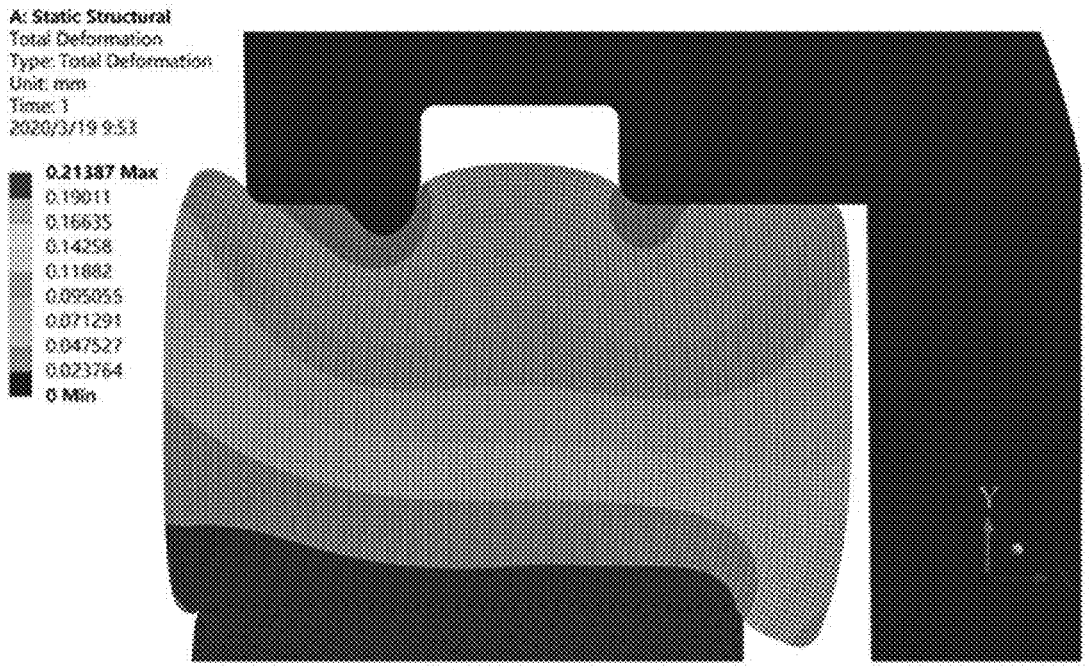
FIG. 8 is a schematic diagram of simulation analysis of providing a vent groove and a seal member that are of a third specification on a separating plate shown in FIG. 5.
Figure 9:
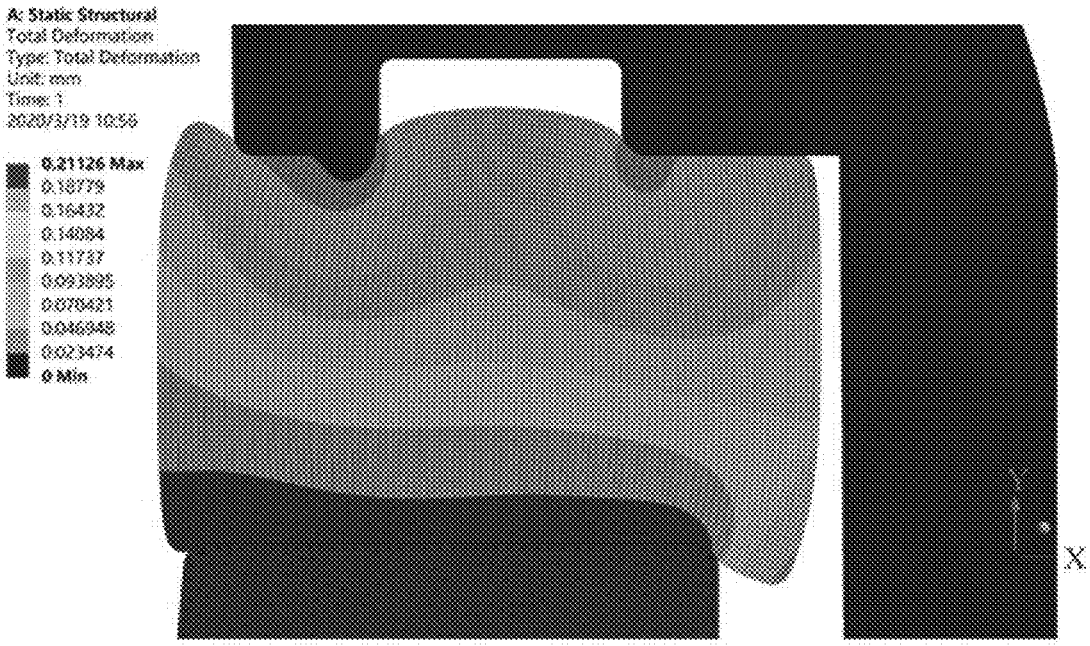
FIG. 9 is a schematic diagram of simulation analysis of providing a vent groove and a seal member that are of a fourth specification on a separating plate shown in FIG. 5.

In an embodiment, as shown in FIG. 5, a side of the separating plate 22 that faces away from the liquid storage cavity 12 is provided with the vent groove 26, and the vent groove 26 is covered by the seal member 40 and only a vent opening is exposed to be in communication with the through hole 220, and the air inlet is exposed to be in communication with the vaporization cavity 51.

Because the vent grooves 26 are all provided on a side of the separating plate 22 that faces away from the liquid storage cavity 12, the e-liquid in the vent groove 26 relatively has a same hydraulic value. Therefore, the risk of liquid leakage due to the excessively high hydraulic value of the e-liquid in the vent groove 26 can be reduced.

The vent groove 26 may be provided in a detour manner on the separating plate 22 to increase a length and increase a space for storing the e-liquid. The vent groove 26 may also be provided in a straight line, provided that the vent groove 26 can be in communication with the through hole 220 and the external air, which is not limited in this application.

The plurality of vent grooves 26 may further be provided, and the plurality of vent grooves 26 may be simultaneously ventilated to increase the air pressure in the liquid storage cavity 12, and the plurality of vent grooves 26 may also be simultaneously fed with liquid, so as to reduce the air pressure in the liquid storage cavity 12. Therefore, the plurality of vent grooves 26 can increase the convenience of adjusting the air pressure in the liquid storage cavity 12, so that the air pressure in the liquid storage cavity 12 can be quickly adjusted. One vent groove 26 can also be provided, and the quantity of the vent grooves 26 is not limited in this application.

A side of the separating plate 22 that faces away from the liquid storage cavity 12 is further provided with a buffer groove 27, the vent groove 26 flows through the buffer groove 27, a cross-sectional area of the buffer groove 27 in a path direction of the vent groove 26 is greater than a cross-sectional area of the vent groove 26 in a same direction, and the seal member 40 covers the vent groove 26 and the buffer groove 27 to prevent liquid leakage in the vent groove 26 and the buffer groove 27.

The buffer groove 27 is configured to store the e-liquid, and the cross-sectional area of the buffer groove 27 in the path direction of the vent groove 26 is greater than the cross-sectional area of the vent groove 26 in the same direction. Therefore, the liquid storage capacity of the vent groove 26 can be improved, so as to avoid leakage of the e-liquid from the vent groove 26.

After research, it is found that a depth of the vent groove 26 should be set ranging from 0.1 mm to 0.5 mm, a width of the vent groove 26 in a direction perpendicular to the path direction of the vent groove 26 should be set ranging from 0.1 mm to 0.5 mm, a width of the buffer groove 27 is greater than the width of the vent groove 26, and a depth of the buffer groove 27 is greater than or equal to the depth of the vent groove 26.

Referring to FIG. 6 to FIG. 9, sealing is performed on an end surface by pressing the seal member 40 through the vaporization core 30, so that the e-liquid can only flow from the vent groove 26. A structure that the vent groove 26 is provided on the side of the separating plate 22 that faces away from the liquid storage cavity 12 is used as a research object, and simulation analysis is performed on a size relationship between squeeze and deformation of the seal member 40 and the width of the vent groove 26.

During the analysis, it is found that when the depth of the vent groove 26 is less than 0.1 mm or the width of the vent groove 26 is less than 0.1 mm, the capillary tension exerted by the vent groove 26 on the e-liquid is too large, which causes ventilation to be difficult, and is not conducive to adjust the air pressure in the liquid storage cavity 12. In a process in which the width of the vent groove 26 is gradually increased from 0.1 mm to 0.5 mm, the squeeze and deformation of the seal member 40 corresponding to the vent groove 26 are gradually increased. When the depth of the vent groove 26 is greater than 0.5 mm or the width of the vent groove 26 is greater than 0.5 mm, the capillary tension exerted by the vent groove 26 on the e-liquid is too small, and the vent groove 26 is prone to liquid leakage. In addition, when the seal member 40 covers the vent groove 26, a space for deforming and squeezing the vent groove 26 is too large, and there is a risk of blocking the vent groove 26, which is not conducive to adjust the air pressure in the liquid storage cavity 12.

Therefore, the depth of the vent groove 26 ranges from 0.1 mm to 0.5 mm, and the width of the vent groove 26 ranges from 0.1 mm to 0.5 mm, which can not only ensure the appropriate capillary tension exerted by the vent groove 26 on the e-liquid, but also prevent the seal member 40 from blocking the vent groove 26. Therefore, it is conducive to adjust the air pressure of the liquid storage cavity 12 through the vent groove 26 and the buffer groove 27, so as to avoid the occurrence of liquid leakage and poor liquid flow of the vaporizer 100.

In this embodiment, the separating plate 22 is provided with a through hole 220, and the through hole 220 is in communication with the liquid storage cavity 12 and the vaporization core 30.

The separating plate 22 is provided with two vent grooves 26, the two vent grooves 26 are adjacent to each other in an end-to-end manner and are provided around the through hole 220 of the separating plate 22, and the two vent grooves 26 have the same length.

Specifically, an air inlet of one of the vent grooves 26 is adjacent to a vent opening of an other vent groove 26, and a vent opening of the vent groove 26 is adjacent to the air inlet of the other vent groove 26. In addition, the two vent grooves 26 are provided around the through hole 220, the vent opening is in communication with the liquid storage cavity 12, and the air inlet is in communication with the external air. Therefore, the vent groove 26 can have a greater length, more e-liquid can be stored, and the air pressure in the liquid storage cavity 12 can also be easily adjusted. In addition, the vent openings of the two vent grooves 26 are provided at different positions, which can prevent bubbles generated by the vent openings provided at a same portion from being aggregated and increasing the difficulty of liquid flow of the e-liquid.

The length and cross-sectional area of the vent groove 26 and the length and cross-sectional area of the buffer groove 27 can be set according to specifications of the vaporizer 100, so as to adjust the air pressure in the liquid storage cavity 12.

Figure 10:
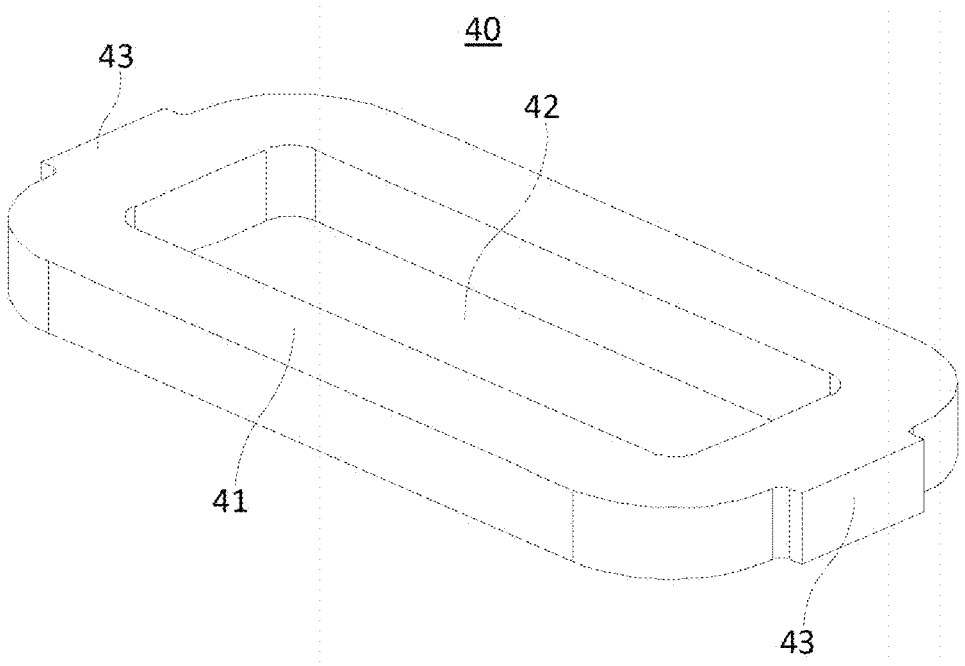
FIG. 10 is a schematic structural diagram of a seal member of the vaporizer shown in FIG. 4.

In this embodiment, as shown in FIG. 10, the seal member 40 includes a seal ring gasket 41 and two isolation gaskets 43 separately arranged on two opposite ends of the seal ring gasket 41, the seal ring gasket 41 includes the opening 42, the isolation gasket 43 abuts against the housing 21, and an air inlet of the vent groove 26 is exposed from the seal ring gasket 41 and is misaligned with the isolation gasket 43. In this way, the air inlet of the vent groove 26 is in communication with the vaporization cavity 51, and then can be in communication with the external air.

In some other embodiments, the vent groove 26 is provided on the housing 21 on the side of the separating plate 22 that faces away from the liquid storage cavity 12. In addition, the vent opening of the vent groove 26 is provided on the separating plate 22 to be in communication with the liquid storage cavity 12, the seal member 40 covers the vent groove 26, and the air inlet of the vent groove 26 is in communication with the external air.

The buffer groove 27 may also be provided on a path of the vent groove 26, and the vent groove 26 flows through the buffer groove 27. Descriptions on the specifications and sizes of the vent groove 26 and the buffer groove 27 in the foregoing embodiments are also applicable to this embodiment, and are not repeated herein.

Figure 11:
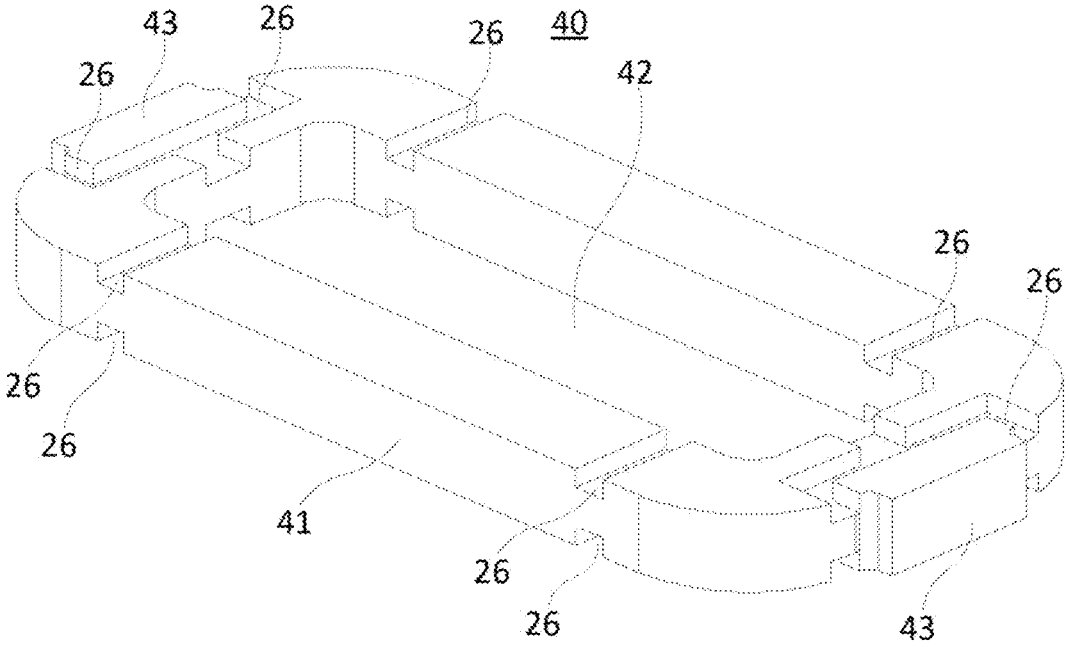
FIG. 11 is another schematic structural diagram of a seal member of the vaporizer shown in FIG. 4.

In another embodiment, referring to FIG. 11, the seal member 40 is provided with a vent groove 26. Specifically, a side of the seal member 40 that faces the separating plate 22 and/or a side of the seal member 40 that faces the vaporization core 30 are/is provided with the vent groove 26, or the vent groove 26 may further be provided in the seal member 40.

For example, a side of the seal member 40 that faces the separating plate 22 and/or a side of the seal member 40 that faces the vaporization core 30 are/is provided with six vent grooves 26. In this way, the air pressure in the liquid storage cavity 12 can be extremely easily adjusted.

Referring to FIG. 5 to FIG. 9 and FIG. 11, relatively speaking, the seal member 40 is greatly squeezed and deformed. The vent groove 26 is provided on the seal member 40, and the vent groove 26 is easily cut off by the seal member 40 that is squeezed and deformed. Compared with the ventilation effect of the vent groove 26 being provided on the separating plate 22, the ventilation effect of the vent groove 26 being provided on the seal member 40 is relatively poor; and if a specification and a size of the vent groove 26 is increased to improve the ventilation effect of the vent groove 26 provided on the seal member 40, considering that a force of the seal member 40 may be uneven at different positions, some of the vent grooves 26 are greatly deformed and squeezed, so that the ventilation effect of the vent grooves 26 is poor, and some of the vent grooves 26 are less deformed and squeezed, so that the vent grooves 26 are prone to liquid leakage. Therefore, generally, performances of a solution in which the vent groove 26 is provided on the separating plate 22 are better than performances of a solution in which the vent groove 26 is provided on the seal member 40.

Alternatively, in some embodiments, referring to FIG. 4, FIG. 5, and FIG. 11, a side of the separating plate 22 that faces away from the liquid storage cavity 12 is provided with a vent groove 26, and the seal member 40 is also provided with a vent groove 26. For example, a vent groove 26 is provided on a side of the separating plate 22 that faces away from the liquid inlet cavity 23, an other vent groove 26 is provided on a side of the seal member 40 that faces the separating plate 22, and the two vent grooves 26 are provided at different positions. In this way, the quantity of vent grooves 26 that can be provided can be effectively increased, thereby increasing the convenience of adjusting the air pressure in the liquid storage cavity 12 and avoiding liquid leakage; or the two vent grooves 26 are provided in alignment, thereby reducing groove depths of the vent grooves 26 provided in the separating plate 22 and the seal member 40, which can effectively ensure that the separating plate 22 does not receive too much damage on the strength due to the arrangement of the vent grooves 26. In addition, a value obtained by adding values of the groove depths of the two vent grooves 26 provided in alignment ranges from 0.1 mm to 0.5 mm.

In addition, the vent grooves 26 can further be provided on the side of the seal member 40 that faces away from the separating plate 22, or a side of the seal member 40 that faces the separating plate 22 and a side of the seal member 40 that faces the vaporization core 30 are both provided with the vent grooves 26, or the vent grooves 26 may further be provided in the seal member 40, which is not limited in this application.

Different from a situation in the related art, this application discloses a vaporizer and an electronic vaporization device. In this application, the vent groove is provided between the mounting base and the seal member, and the vent groove is in communication with the liquid storage cavity and the external air. As a result, dynamic balance is achieved between the air pressure, hydraulic pressure, and the capillary tension and resistance exerted by the vent groove on the e-liquid in the liquid storage cavity and the external air pressure by adjusting the e-liquid stored in the vent groove. In addition, when the air pressure in the liquid storage cavity of the vaporizer is too low, the external air can enter the liquid storage cavity through the vent groove, thereby increasing the air pressure in the liquid storage cavity, so as to avoid a situation of poor liquid flow due to the extremely low air pressure in the cavity, and the quality of the vaporizer is improved.

The foregoing descriptions are merely embodiments of this application, and the protection scope of this application is not limited thereto. All equivalent structure or process changes made according to the content of this specification and accompanying drawings in this application or by directly or indirectly applying this application in other related technical fields shall fall within the protection scope of this application.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A vaporizer, configured to vaporize e-liquid, comprising:

a liquid storage cavity configured to store the e-liquid;

a mounting base comprising a housing and a separating plate arranged in the housing, the separating plate comprising a through hole, and the through hole being in communication with the liquid storage cavity;

a vaporization core mounted in the mounting base and configured to heat and vaporize the e-liquid;

a seal member arranged between the separating plate and the vaporization core, the seal member comprising an opening that is in communication with the through hole for the e-liquid to enter the vaporization core through the opening; and two vent grooves provided between the mounting base and the seal member, the two vent grooves being in communication with the liquid storage cavity and external air, wherein the two vent grooves are provided on a side of the separating plate that faces away from the liquid storage cavity, wherein the two vent grooves comprise a first vent groove and a second vent groove that are adjacent to each other in an end-to-end manner and are provided around the through hole of the separating plate, wherein the two vent grooves are arranged in a same plane, and wherein an air inlet of the first vent groove is adjacent to a vent opening of the second vent groove, and a vent opening of the first vent groove is adjacent to an air inlet of the second vent groove.

2. The vaporizer of claim 1, wherein the side of the separating plate that faces away from the liquid storage cavity is further provided with a buffer groove, wherein the buffer groove is provided on a path of the first vent groove or on a path of the second vent groove, and wherein a cross-sectional area of the buffer groove in a path direction of the first vent groove or the second vent groove is greater than a cross-sectional area of the first vent groove or the second vent groove in the path direction, and the seal member covers the buffer groove.

3. The vaporizer of claim 2, wherein a depth of at least one vent groove of the two vent grooves ranges from 0.1 mm to 0.5 mm, a width of the at least one vent groove in a direction perpendicular to the path direction ranges from 0.1 mm to 0.5 mm, a width of the buffer groove is greater than the width of the at lease one vent groove, and a depth of the buffer groove is greater than or equal to a depth of the at least one vent groove.

4. The vaporizer of claim 1, wherein the seal member comprises an isolation gasket, wherein the isolation gasket abuts against the housing of the mounting base, and wherein at least one air inlet of the first vent groove and the second vent groove is misaligned with the isolation gasket.

5. The vaporizer of claim 1, further comprising:

a base connected to the mounting base, the base abutting against the vaporization core, wherein a vaporization cavity is formed between the base, the vaporization core, and the mounting base, wherein the two vent grooves are in communication with the vaporization cavity, wherein a bottom wall of the base that faces away from the mounting base is provided with a vent hole, and wherein the vent hole is in communication with the vaporization cavity and the external air.

6. An electronic vaporization device, comprising:

a body assembly; and the vaporizer of claim 1, wherein the body assembly is connected to the vaporizer and configured to supply power to the vaporizer.

7. The vaporizer of claim 1, wherein the seal member comprises a seal ring gasket and two isolation gaskets respectively arranged on two opposite ends of the seal ring gasket, the seal ring gasket comprising the opening.

8. The vaporizer of claim 1, wherein the first vent groove and the second vent groove each include an inner end and an outer end, the inner end being arranged closer to the through hole of the separating plate than the outer end.

9. The vaporizer of claim 8, wherein the inner end of the first vent groove extends in a first direction laterally outward relative to a direction of the through hole of the separating plate, and wherein the inner end of the second vent groove extends in a second direction laterally outward relative to a direction of the through hole of the separating plate, the first direction and the second direction being opposite directions relative to one another.

10. The vaporizer of claim 9, wherein the first vent groove extends from the inner end of the first vent groove in a circumferential direction around the through hole of the separating plate, and wherein the second vent groove extends form the inner end of the second vent groove in the circumferential direction.

11. The vaporizer of claim 9, wherein both the inner end of the first vent groove and the outer end of the second vent groove extend in the first direction, and wherein both the inner end of the second vent groove and the outer end of the first vent groove extend in the second direction.

12. The vaporizer of claim 8, wherein the inner end of the first vent groove is adjacent the outer end of the second vent groove, and wherein the inner end of the second vent groove is adjacent the outer end of the first vent groove.

13. The vaporizer of claim 1, wherein the two vent grooves are rotationally symmetrical to one another about the through hole of the separating plate.

14. The vaporizer of claim 1, wherein the first vent groove and the second vent groove each extend in their entirety within the same plane.

* * * * *